US008334809B2

(12) United States Patent
Nichols et al.

(10) Patent No.: US 8,334,809 B2
(45) Date of Patent: Dec. 18, 2012

(54) ACTIVE ELECTRONICALLY SCANNED ARRAY ANTENNA FOR SATELLITE COMMUNICATIONS

(75) Inventors: Richard W. Nichols, Manhattan Beach, CA (US); James S. Mason, Richardson, TX (US); Gilbert M. Shows, Plano, TX (US); Joel C. Roper, Plano, TX (US); Raymond D. Eppich, Plano, TX (US); Gustavo A. Burnum, Athens, GA (US); Ike Chang, Santa Monica, CA (US)

(73) Assignee: Raytheon Company, Waltham, MA (US)

( * ) Notice: Subject to any disclaimer, the term of this patent is extended or adjusted under 35 U.S.C. 154(b) by 1026 days.

(21) Appl. No.: 12/288,635

(22) Filed: Oct. 22, 2008

(65) Prior Publication Data

US 2010/0099370 A1 Apr. 22, 2010

(51) Int. Cl.
*H01Q 1/38* (2006.01)

(52) U.S. Cl. ..... 343/700 MS

(58) Field of Classification Search ..... 343/700 MS, 343/702, 844
See application file for complete search history.

(56) References Cited

U.S. PATENT DOCUMENTS 4,119,972 A * 10/1978 Fletcher et al. ..... 343/844
5,457,465 A * 10/1995 Collier et al. ..... 342/374
6,314,305 B1 * 11/2001 Solondz et al. ..... 455/562.1
6,774,848 B2 * 8/2004 Wright ..... 343/700 MS
7,397,425 B2 * 7/2008 Ranta et al. ..... 342/374
7,479,930 B2 * 1/2009 Young ..... 343/844
7,538,735 B2 * 5/2009 Crouch ..... 343/754
8,063,832 B1 * 11/2011 Weller et al. ..... 343/700 MS
2001/0045914 A1 * 11/2001 Bunker ..... 343/895
2004/0174303 A1 * 9/2004 Duxbury et al. ..... 343/700 MS
2005/0206563 A1 * 9/2005 Guy ..... 342/372
2010/0029215 A1 * 2/2010 Honkanen et al. ..... 455/63.3

* cited by examiner

*Primary Examiner* — Huedung Mancuso

(74) *Attorney, Agent, or Firm* — Christie, Parker & Hale, LLP

(57) ABSTRACT

An electronically scanned array antenna. The novel antenna includes a first planar array of antenna elements and one or more side planar arrays of antenna elements, each side array adjacent to the first array and tilted at a predetermined angle relative to the first array. In an illustrative embodiment, the antenna also includes a plurality of transmit/receive modules, each module coupled to one antenna element. Each transmit/receive module includes phase shifters for varying the relative phases of the antenna elements to form a desired overall beam pattern, and a low noise amplifier and high power amplifier for amplifying signals received and transmitted by the antenna element, respectively. In an illustrative embodiment, a processor provides individual phase and channel enable control signals for independently controlling the phase shifters and amplifiers, respectively, of each module.

27 Claims, 5 Drawing Sheets

ACTIVE ELECTRONICALLY SCANNED ARRAY ANTENNA FOR SATELLITE COMMUNICATIONS

BACKGROUND OF THE INVENTION

1 . Field of the Invention

The present invention relates to radio frequency electronics. More specifically, the present invention relates to electronically scanned array antennas for satellite communications.

2 . Description of Related Art

Conventional satellite communication antennas have typically relied on mechanical steering approaches using a "dish" antenna to establish and maintain a link with a satellite. A dish antenna typically includes a parabolic reflector dish and a feed element that couples RF (radio frequency) signals between the reflector dish and a modem. The modem modulates data onto a carrier signal to provide a signal to be transmitted to the satellite by the antenna, and also demodulates a signal received from the satellite to extract encoded data.

For "communications on the move" or mobile applications in which the antenna is located on a moving platform such as a ground vehicle, airplane, or ship, the antenna needs to be capable of scanning in different directions in order to locate and then follow a satellite as the platform moves. This is typically accomplished by mounting the dish antenna on a gimbal and mechanically steering the gimbal to point the antenna in the desired direction.

When it is desired to communicate with a satellite from a vehicle that is moving, the use of mechanically steered dish antennas presents a variety of mechanical problems related to the motion of the vehicle over rough roads and uneven terrain, or during periods of high maneuverability. Stabilization techniques are commonly used that place the antenna on a platform that is mechanically stabilized; however, these approaches often can not provide the stability required in highly dynamic maneuvers on uneven terrain, and also add cost and complexity to the system.

Mechanically steered antennas also include gimbal mechanisms, such as mechanical servos, drive motors, gears, drive belts, etc., that typically require significant amounts of time and expense for maintenance and may also break when subject to erratic movement. In addition, conventional dish antennas are typically large and bulky, making them more visible to radar detection.

An alternative to the conventional dish antenna is an electronically scanned array (ESA) or phased array antenna. An ESA includes an array of several individual radiating antenna elements whose relative phases are controlled such that the overall beam from the array radiates in a particular direction due to constructive and destructive interference between the individual elements. Phased arrays are typically low profile, robust to movement, and are capable of switching beam directions in fractions of a millisecond. However, conventional ESA antennas, which have been used predominantly in radar applications, are typically not suitable for use in mobile satellite communications applications due to their large size, heavy weight, and high cost.

Prior attempts at adapting ESA antennas for satellite communications have used passive ESAs in which the entire antenna array is driven by, and interfaces with a modem through the use of intermediary single interface elements such as, a low noise amplifier (LNA), a high power amplifier (HPA), and a diplexer. These external elements are typically large and costly, and create a single point of failure for the system in that failure of one of these elements renders the passive ESA antenna unusable.

Hence, a need exists in the art for an improved antenna for on-the-move satellite communications that offers low profile, smaller size, and lower cost than prior approaches.

SUMMARY OF THE INVENTION

The need in the art is addressed by the electronically scanned array antenna of the present invention. The novel antenna includes a first planar array of antenna elements and one or more side planar arrays of antenna elements, each side array adjacent to the first array and tilted at a predetermined angle relative to the first array. In an illustrative embodiment, the antenna also includes a plurality of transmit/receive modules, each module coupled to one antenna element and including a receive circuit and a transmit circuit. Each receive circuit includes a low noise amplifier adapted to receive a first channel enable control signal and in accordance therewith amplify a signal received from the antenna element, and a first phase shifter adapted to receive a first phase control signal and in accordance therewith vary a phase of the received signal. Each transmit circuit includes a high power amplifier adapted to receive a second channel enable control signal and in accordance therewith amplify a transmit signal for transmission by the antenna element, and a second phase shifter adapted to receive a second phase control signal and in accordance therewith vary a phase of the transmit signal. In an illustrative embodiment, a processor provides individual phase and channel enable control signals for independently controlling the phase shifters and amplifiers, respectively, of each module.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto.

Those having ordinary skill in the art and access to the teachings provided herein will recognize additional modifications, applications, and embodiments within the scope thereof and additional fields in which the present invention would be of significant utility.

The present invention provides a novel antenna for satellite communications that uses an active electronically scanned array (ESA), or phased array. Unlike dish antennas that use mechanical servos and drive motors to steer the dish antenna to the desired angle, a phased array steers the transmit/receive beam by independently controlling the phase relationships of the active radiating elements of the array. Because phased array antenna beam patterns can be switched in fractions of a millisecond, the antenna can lock onto a satellite channel and maintain lock even if the antenna is mounted on a vehicle that is moving across uneven terrain or performing highly dynamic maneuvers.

The novel antenna design of the present teachings provides a thin, flat antenna (nominally less than two inches in height) that can maintain coverage over nearly an entire hemisphere without any moving parts in a low profile package that greatly reduces visibility as compared to conventional satellite dishes.

In a preferred embodiment, the novel antenna is adapted for use in satellite communications. In an illustrative embodiment, the antenna is designed for use at L-band frequencies appropriate for communicating with the INMARSAT I-4 satellite network. The novel antenna array is a full duplex, single aperture antenna allowing for simultaneous receive and transmit through the use of frequency multiplexing, and fully active, providing independently controlled transmit and receive channels for each radiating element. This allows the antenna to receive and transmit in different directions at the same time, consistent with satellite architecture.

Figure 1A:
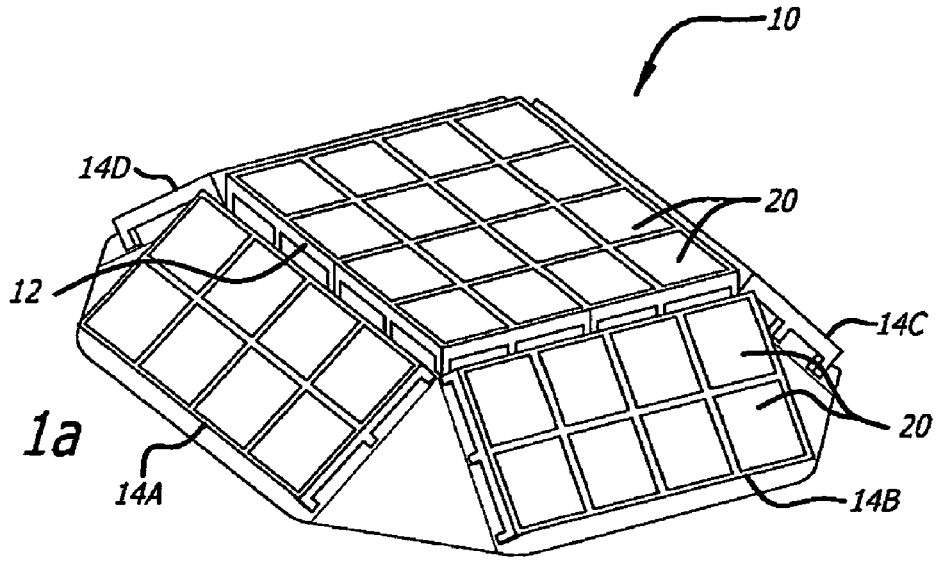
FIG. 1*a* is a simplified three-dimensional diagram of an antenna designed in accordance with an illustrative embodiment of the present invention.

FIG. 1*a* is a simplified diagram showing a three-dimensional view of an antenna 10 designed in accordance with an illustrative embodiment of the present invention. The novel antenna 10 is an ESA having a unique "carapace" design comprised of five sections: a top, center section 12, and four side sections 14A, 14B, 14C, and 14D that are adjacent to the center section 12 and tilted relative to the center section 12. The center section 12 includes a flat, planar (two-dimensional) array of patch antenna elements 20. In the illustrative embodiment of FIG. 1*a* , the center section 12 includes a 4×4 array of sixteen antenna elements 20 arranged in a square grid. Each patch antenna element 20 is formed from a metal patch disposed on a patch dielectric substrate over a ground plane. In the illustrative embodiment, the patch radiating elements 20 are square or rectangular patches.

Figure 1B:
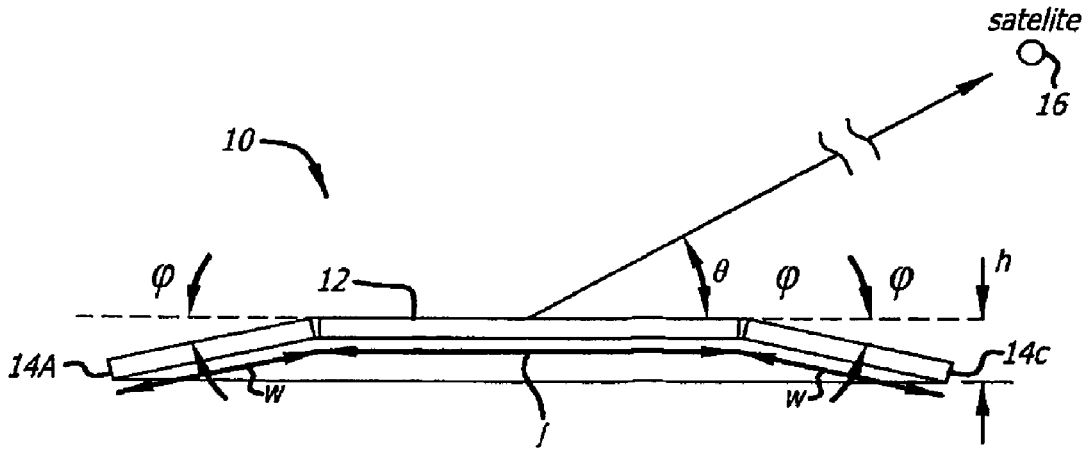
FIG. 1*b* is a cross-sectional side view of the illustrative antenna of FIG. 1*a*.

The center section 12 is surrounded on all four sides by a side section 14. Each side section 14 includes a smaller (relative to the center section 12) two-dimensional planar array of patch antenna elements 20, and each side section 14 is tilted at a particular angle ϕ relative to the center section 12. FIG. 1*b* is a cross-sectional side view of the illustrative antenna 10 of FIG. 1*a* , showing the tilt angle ϕ of the side sections (sections 14A and 14C are shown in the figure) relative to the center section 12. As shown in FIG. 1*b* , the top center section 12 is a flat square panel having sides of length l and each side section 14 is a flat rectangular panel having width w and length l. Each side section 14 is placed adjacent to the center section 12 such that the side of length l is next the center section 12. Each side section 14 is tilted at an angle ϕ relative to the center section 12, and the overall antenna structure 10 has a total height h.

In an illustrative embodiment suitable for L-band communications, each radiating element 20 is a square patch having sides of approximately 3". The center section 12 is therefore about 12" square, each side section 14 is approximately 12"× 6" (l=12" and w=6" in FIG. 1*b*), and the height h of the antenna array 10 varies by geometry as the angle ϕ increases above zero degrees.

The angle ϕ is chosen such that the overall antenna 10 provides sufficient coverage for the desired application. The amount of coverage needed depends on where the antenna is located and the relative position of the satellite 16 to the antenna. In an illustrative embodiment, the antenna 10 is designed to cover the near full upper hemisphere such that it can connect to the INMARSAT satellite network from almost anywhere in the world. In an illustrative embodiment, the top section 12 with its planar array alone (without the arrays of the side sections 14) can communicate with a satellite 16 that is at an elevation θ of 30° above the horizon or higher using active electronic beam steering. The addition of an array in a side section 14 increases the coverage of the antenna resulting from a combination of the increased number of aperture elements and the tilt angle ϕ of the section 14. For example, a side section 14 tilted at an angle ϕ of 45° will increase coverage of the antenna 10 by nearly 30°. In a preferred embodiment, each side section 14 is tilted at an angle ϕ of 45° relative to the center section 12 such that the overall antenna 10 can communicate with any satellite approximately 5 degrees above horizon level (near full upper hemisphere coverage), consistent with a satellite having line of sight access to the antenna.

All of the antenna elements 20 may not be in use at the same time. In an illustrative embodiment, only the elements 20 in the center section 12 and the elements 20 in up to two side sections 14 are operating at any given time. Thus, if the center section 12 includes sixteen elements and each side section 14 includes eight elements, only thirty-two or fewer elements are operating at any given time. Which antenna elements 20 are turned on is dependent on the location (elevation and azimuth) of the antenna relative to the fixed satellite 16 location. If the satellite 16 has an elevation θ of 30° or higher above the horizon relative to the antenna 10, then the antenna 10 can communicate with the satellite 16 by using only the elements 20 in the center section 12 (the antenna elements 20 in the side sections 14 are turned off). If the satellite 16 has an elevation θ less than 30° above the horizon and an azimuth aligned with one of the side sections 14, then the antenna elements 20 in the center section 12 and in that particular side section 14 are turned on (the antenna elements 20 in the other side sections 14 are turned off). If the satellite 16 has an elevation θ less than 30° above the horizon and an azimuth between two of the side sections 14, then the antenna elements 20 in the center section 12 and in the two particular side sections 14 are turned on (the antenna elements 20 in the other side sections 14 are turned off).

In operation, the phase of each antenna element 20 is varied by control electronics to steer the transmit and receive beams of the overall antenna 10 resulting in electronic beam steering. In accordance with the present teachings, the electronics for controlling and driving the antenna elements 20 are located directly beneath the radiating elements 20 and integrated with the antenna patches 20 to form a compact, integrated antenna/circuit module.

Figure 2A:
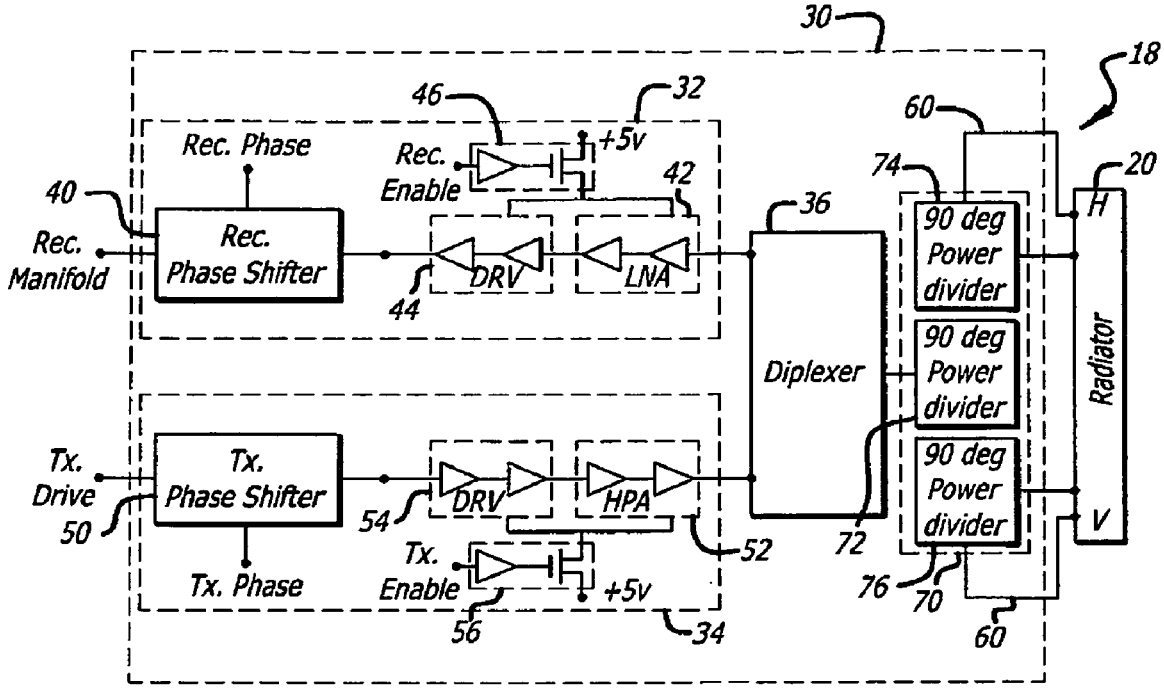
FIG. 2*a* is a simplified block diagram of an integrated antenna/circuit module designed in accordance with an illustrative embodiment of the present invention.

FIG. 2*a* is a simplified block diagram of a single integrated antenna/circuit module 18 designed in accordance with an illustrative embodiment of the present invention. The antenna/circuit module 18 includes a transmit/receive (T/R) circuit 30 coupled to an individual antenna radiating element 20 for controlling and driving the radiating patch 20. In accordance with the present teachings, a separate T/R module 30 is coupled to each radiating element 20 of the antenna array 10. FIG. 2*a* shows only one radiating element 20 and its corresponding T/R module 30. This circuit is duplicated for every antenna element 20 of the array 10.

In a preferred embodiment, the T/R module 30 includes independently controlled receive and transmit channels 32 and 34, respectively, allowing the overall antenna receive and transmit beams to be pointed in different directions at the same time (allowing, for example, the antenna 10 to transmit data to one satellite while receiving data from a different satellite consistent with satellite architectures and operating frequencies). A diplexer 36 couples both the receive channel 32 and transmit channel 34 to the radiator element 20. The diplexer 36 implements frequency multiplexing such that signals in a first frequency band are coupled between the radiator 20 and the receive channel 32 while signals in a second frequency band are coupled between the radiator 20 and the transmit channel 34. This provides a full duplex system that can receive and transmit signals simultaneously. In an illustrative embodiment, the diplexer 36 is compatible with the transmit and receive frequency bands of the INMARSAT satellite network.

The receive channel 32 includes a phase shifter 40 for actively controlling the phase of a received signal from the radiating element 20. The phase shifter 40 also receives a control signal, labeled Rec. Phase in FIG. 2*a* , that controls the value of the phase shift of the receive antenna channel thereby creating the phase array effect for electronically steered beams. The phase shifted signal output by the phase shifter 40 is sent to a receive manifold that combines the received signals from all of the T/R modules 30 in the array 10.

The receive channel 32 also includes a low noise amplifier (LNA) 42 for amplifying a signal received from the radiator 20 (after filtering by the diplexer 36). After traveling the significant distance between the satellite and the antenna, a received signal is typically at a very low level and should be amplified by an LNA before being demodulated. In accordance with the present teachings, the LNA 42 is connected directly to the diplexer 36, as close to the radiating element 20 as possible in order to reduce system noise and provide the highest G/T (the ratio of antenna gain G to noise equivalent temperature T), thereby allowing for a smaller overall antenna size (given a desired G/T). Optionally, the receive channel 32 may also include a driver amplifier 44 connected in series with the LNA 42 between the diplexer 36 and the phase shifter 40. In the illustrative embodiment, the LNA 42 and driver amplifier 44 are both coupled to a voltage supply (a+5 V supply is shown in FIG. 2*a*) by a switch 46, which is controlled by a Rec. Enable control signal. By using the Rec. Enable control signal to turn the switch 46 on and off, the LNA 42 and driver amplifier 44 can be turned on and off, effectively controlling whether or not the radiator element 20 is active for the receive beam.

The transmit channel 34 includes a phase shifter 50 for actively controlling the phase of the transmitted signal from the radiating element 20. The input to the phase shifter 50 is the signal to be transmitted, which is provided by an RF distribution board that splits the transmit signal (provided by a modem) and sends the same signal—the same in both amplitude and phase—to each of the T/R modules 30 of the array 10. The phase shifter 50 also receives a control signal, labeled Tx; Phase in FIG. 2*a* , that controls the value of the phase shift. Depending on the application, the control signals Rec. Phase and Tx. Phase may be independent, allowing for independent receive and transmit beams that can be steered in different directions, or the same control signal may be coupled to both the receive phase shifter 40 and the transmit phase shifter 50, if both the receive and transmit channels will be communicating with the same satellite and independent receive/transmit beam steering is not required.

The transmit channel 34 also includes a high power amplifier (HPA) 52 for amplifying the phase shifted signal output from the transmit phase shifter 50 to a power level appropriate for transmission. The amplified transmit signal output by the HPA 52 is coupled to the radiator 20 by the diplexer 36. In accordance with the present teachings, the HPA 52 is connected directly to the diplexer 36, as close to the radiating element 20 as possible in order to reduce loss in the system. Optionally, the transmit channel 34 may also include a driver amplifier 54 connected in series with the HPA 52 between the diplexer 36 and the phase shifter 50. In the illustrative embodiment, the HPA 52 and driver amplifier 54 are both coupled to a voltage supply (a+5 V supply is shown in FIG. 2*a*) by a switch 56, which is controlled by a Tx. Enable control signal. By using the Tx. Enable control signal to turn the switch 56 on and off, the HPA 52 and driver amplifier 54 can be turned on and off, effectively controlling whether or not the radiator element 20 is active for the transmit beam.

Figure 2B:
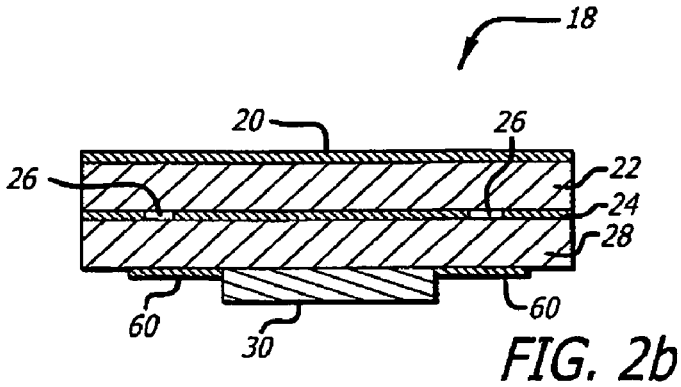
FIG. 2*b* is a simplified cross-sectional diagram of an integrated antenna/circuit module designed in accordance with an illustrative embodiment of the present invention.

In a preferred embodiment, the radiator patch 20 is aperture coupled to the T/R module 30, providing a connector-less integration with the T/R module 30. FIG. 2*b* is a simplified cross-sectional diagram of an integrated antenna/circuit module 18 designed in accordance with an illustrative embodiment of the present invention. Each antenna element 20 includes a metallic patch 20 disposed on a patch substrate 22 (which may include air or any other suitable dielectric) over a ground plane 24. The ground plane 24 includes one or more apertures or slots 26 through which signals are coupled between the patch 20 and the T/R module 30. The T/R module circuit substrate 28 is disposed next to the ground plane 24, parallel to the radiating patch 20 and the ground plane 24. The T/R circuit 30 is implemented (using, for example, electronic components connected by printed circuit board traces) on the circuit substrate 28 opposite the ground plane 24, and includes one or more microstrip transmission lines 60 under the apertures 26 in the ground plane 24 for coupling signals between the diplexer 36 and the radiator patch 20.

Returning to FIG. 2*a* , the integrated antenna/circuit module 18 may also include some mechanism 70 for controlling the polarization of a signal radiated by the antenna element 20. In an illustrative embodiment, the antenna 10 is configured to radiate right-hand circularly polarized (RHCP) waves (for compatibility with the INMARSAT I-4 architecture) and the polarization mechanism 70 includes one or more 90° power dividers or quadrature hybrid couplers. In this embodiment, the radiating element 20 is excited using four input feeds (i.e., four aperture-coupled transmission lines 60), in which each feed is 90° out of phase with respect to the other feeds. In the embodiment of FIG. 2*a* , the T/R module 30 includes three power dividers 72, 74, and 76. The first power divider 72 is coupled between the diplexer 36, the second power divider 74, and the third power divider 76. The second power divider 74 has two ports coupled to the two horizontal feeds (H) of the radiator 20. The third power divider 76 has two ports coupled to the two vertical feeds (V) of the radiator 20.

Figure 3:
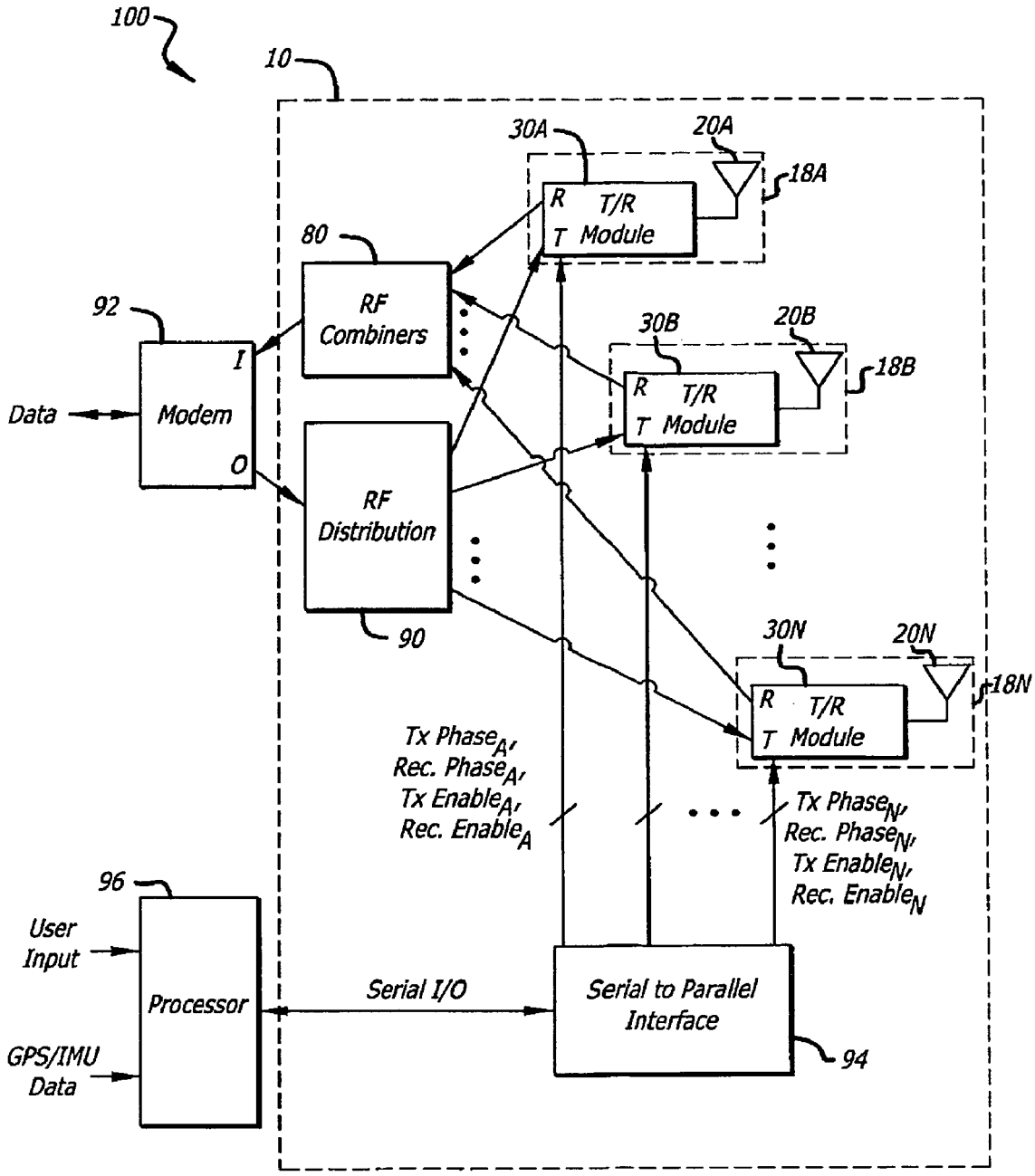
FIG. 3 is a simplified block diagram of a satellite communication system designed in accordance with an illustrative embodiment of the present invention.

FIG. 3 is a simplified block diagram of a satellite communication system 100 designed in accordance with an illustrative embodiment of the present invention. The 10 system 100 includes a novel antenna array 10 as described above with reference to FIGS. 1*a* and 1*b* . The antenna 10 includes an array of N antenna elements 20A-20N, each of which is coupled to a T/R module 30A-30N, respectively. In a preferred embodiment, each antenna element 20A-20N and its associated T/R module 30A-30N, respectively, is implemented as an integrated antenna/circuit module 18A-18N, respectively, as described above with reference to FIGS. 2*a* and 2*b* . The received signals output by each of the T/R modules 30A-30N are fed to a receive manifold 80, which includes one or more RF combiners that combine the received signals from each T/R module 30A-30N to form a single received signal that is then demodulated by a modem 92 and output to the user. The modem 92 also modulates data from the user onto a carrier signal to form a transmit signal that is split by an RF distribution board 90 into N identical signals, each of which is fed to the transmit channel of each T/R module 30A-30N.

In a preferred embodiment, the antenna 10 also includes a serial to parallel interface 94 for coupling control signals (such as Tx. Phase, Rec. Phase, Tx. Enable, and Rec. Enable) to each T/R module 30A-30N. A computer or processor 96 provides the control signals via a serial input/output (to minimize the number of control leads). The serial to parallel interface 94, which may be implemented, for example, using a plurality of serially connected shift registers, then sends the control signals to the T/R modules 30A-30N in parallel. In a preferred embodiment, the serial to parallel interface 94 is implemented as part of the circuit board containing the T/R modules to reduce the number of connectors between different parts of the system 100.

The processor 96 includes software for determining the receive and transmit phases of each antenna element 20 and providing the appropriate control signals (Tx. Phase, Rec. Phase). Separate control signals are provided for each antenna element 20. Thus, the processor 96 provides N Tx. Phase control signals (labeled Tx. $\text{Phase}_A$-Tx. $\text{Phase}_N$ in FIG. 3) and N Rec. Phase control signals (labeled Rec. $\text{Phase}_A$-Rec. $\text{Phase}_N$ in FIG. 3), where N is the total number of antenna elements 20 in the array 10. The relative transmit phases of the antenna elements 20 are chosen such that the overall transmit beam of the antenna array 10 points in a desired direction. Similarly, the relative receive phases of the antenna elements 20 are chosen such that the overall receive beam of the antenna array 10 points in a desired direction. Alternatively, the processor 96 may provide a single phase control signal for each antenna element 20 if the antenna 10 is being used to transmit and receive signals to and from the same satellite.

The desired direction of the transmit/receive beams may be controlled manually by the user, or the processor 96 may instruct the antenna 10 to search for the desired satellite, scanning in different directions (by varying the relative phases of the antenna elements) until a signal lock (based on, for example, received signal strength) is found. Alternatively, in a preferred embodiment, the processor 96 may include software for determining the direction of a satellite based on the known location of a satellite and the location and orientation of the antenna 10, which may be obtained using, for example, a GPS (global positioning system) receiver, a tilt sensor, and a north finding module. An illustrative method for determining the relative direction of a satellite using a GPS receiver and orientation sensors is disclosed in a patent application entitled "Method and System for Controlling the Direction of an Antenna Beam", filed Ser. No. 12/017,916, by R. W. Nichols et al., the teachings of which are incorporated herein by reference.

The processor 96 may also include software for determining which antenna elements 20 should be on or off at any given time and providing the appropriate control signals (Tx. Enable, Rec. Enable). Separate control signals are provided for each antenna element. Thus, the processor 96 provides N Tx. Enable control signals (labeled Tx. $\text{Enable}_A$-Tx. $\text{Enable}_N$ in FIG. 3) and N Rec. Enable control signals (labeled Rec. $\text{Enable}_A$-Rec. $\text{Enable}_N$ in FIG. 3). The transmit or receive channels of the antenna elements may be turned off when the antenna is operating in a receive only or transmit only mode, respectively. Certain antenna elements may also have their receive and/or transmit channels turned off depending on the desired direction of the receive and transmit beams. For example, as described above with reference to FIGS. 1*a* and 1*b*, antenna elements in certain side sections 14 may be turned off depending on the position of the satellite with which the antenna 10 is attempting to communicate.

Figure 4A:
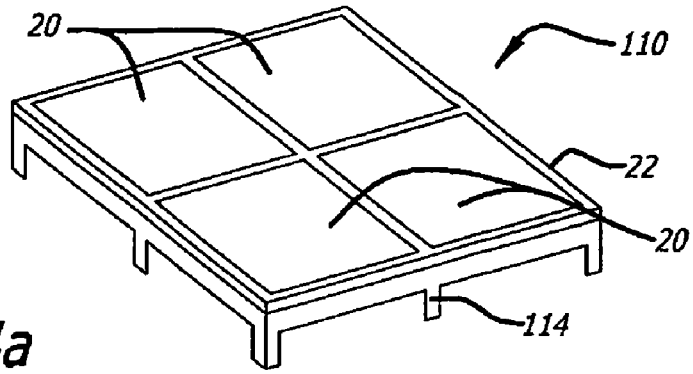
FIG. 4*a* is a three-dimensional view of a subarray antenna/circuit module designed in accordance with an illustrative embodiment of the present invention.

In a preferred embodiment, the antenna array 10 is implemented using a modular design, with a basic module comprising a 2×2 subarray of four radiating elements and associated drive and control electronics. FIG. 4*a* is a three-dimensional view of a subarray antenna/circuit module 110 designed in accordance with an illustrative embodiment of the present invention. The illustrative subarray module 110 includes four patch antenna elements 20 arranged in a 2×2 grid and their associated electronics. The subarray module 110 provides a modular block for building arrays of various sizes. For example, the novel carapace design shown in FIG. 1*a* can be implemented by using four subarray modules 110 for the center section 12 and two subarray modules 110 for each side section 14A-14D.

Figure 4B:
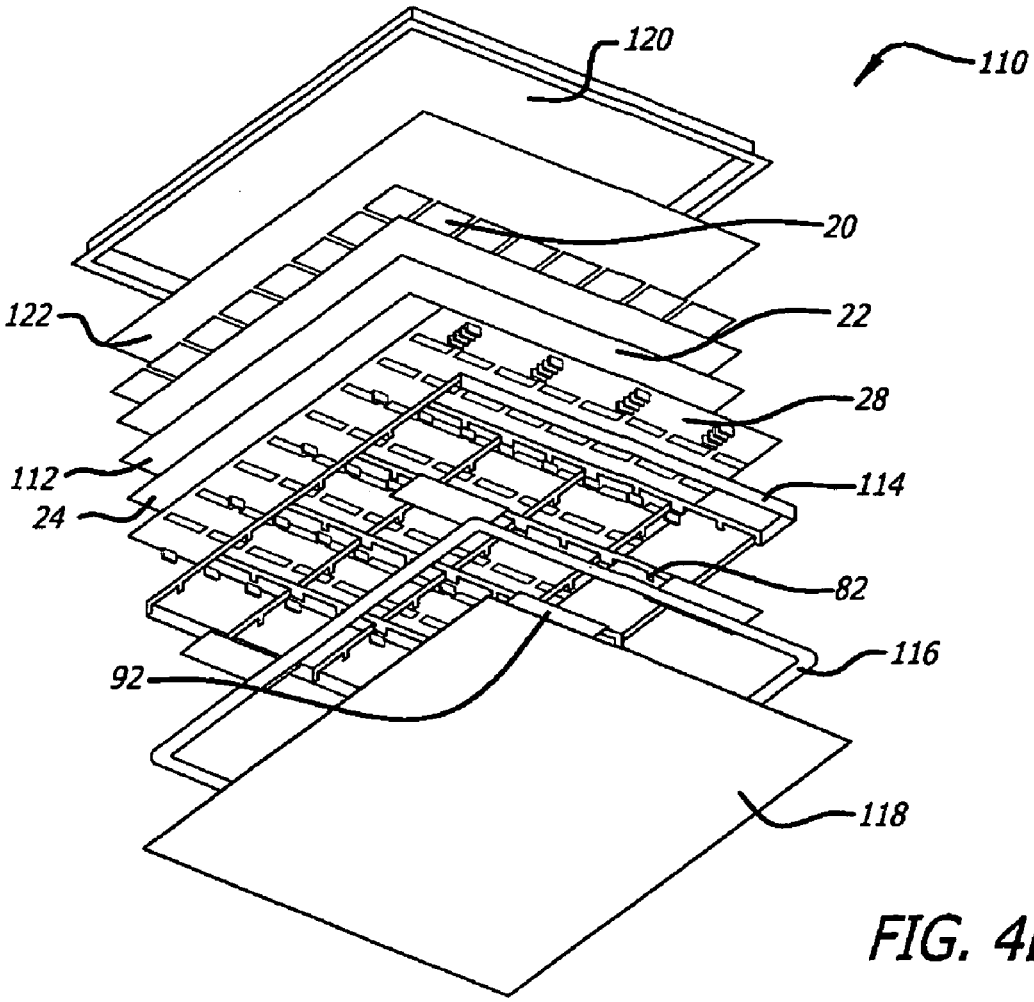
FIG. 4*b* is an exploded view of a subarray antenna/circuit module designed in accordance with an illustrative embodiment of the present invention.

FIG. 4*b* is an exploded view of a subarray antenna/circuit module 110 designed in accordance with an illustrative embodiment of the present invention, showing the different layers of the module 110. The antenna/circuit module 110 is implemented using a tile architecture to provide a lower profile and integration of the patch antenna and T/R circuitry. In the illustrative embodiment, the subarray module 110 includes four patch radiators 20 etched on a patch substrate 22 and a printed circuit board 28 mounted parallel to the patch substrate 22. A ground plane 24 (with apertures located beneath each radiator 20) is disposed on a first side of the circuit board 28 (closest to the patch substrate 22), and the drive and control electronics for each radiator 20 are populated on the opposite side of the board 28. In an illustrative embodiment, a foam spacer 112 is placed between the patch substrate 22 and the ground plane 24. The foam spacer 112 provides a "near-air" dielectric to space the patches 20 away from the ground plane 24. Air provides the broadest bandwidth but comes at the cost of maximum height. A higher-dielectric material would lower the height but reduce the bandwidth. An alternative method would be to use stand-offs, but the foam has the advantage of providing more structure and displacing air and its associated moisture.

The electronics on the board 28 include four T/R modules 30 and the aperture coupled transmission lines 60 as shown in FIG. 2*a* . The circuit board 28 may also include a serial to parallel interface 94 for providing control signals to the T/R modules 30 (as shown in FIG. 3) and circuits such as voltage regulators for distributing power to the components of the T/R modules 30. In a preferred embodiment, in order to minimize costs, the electronic components of the circuit board 28 (including, for example, diplexers, phase shifters, and amplifiers) are implemented using commercial off-the-shelf components with general linearity from UHF to 2.5 GHz.

The integrated patch antenna 20 and circuit board 28 are mounted on a modular frame 114, which provides structural support for the assembly. The module 110 may also include a 4 to 1 RF combiner board 82, which combines the received signals from each of the four T/R modules 30 to form one RF output signal, and an RF distribution board 92, which receives an RF transmit signal (from the modem 92) and distributes it to the four T/R modules 30. Thus, in this embodiment, the subarray module 110 has one RF input and one RF output. The module 110 may also include shielding 116 for protecting the antenna circuitry from electromagnetic interference.

A flat sheet of metal 118 provides a back cover for the module 110, and a radome 120 may also be provided to protect the radiator elements 20. In the embodiment of FIG. 4*b*, a foam spacer 122 is placed between the radome 120 and the layer of patch elements 20 to add structural support and to keep the radome 120 from touching the radiating elements 20.

A plurality of 2×2 subarray modules 110 as shown in FIGS. 4*a* and 4*b* can be used to form a larger antenna array, such as the antenna array 10 shown in FIGS. 1*a* and 1*b*.

Figure 5:
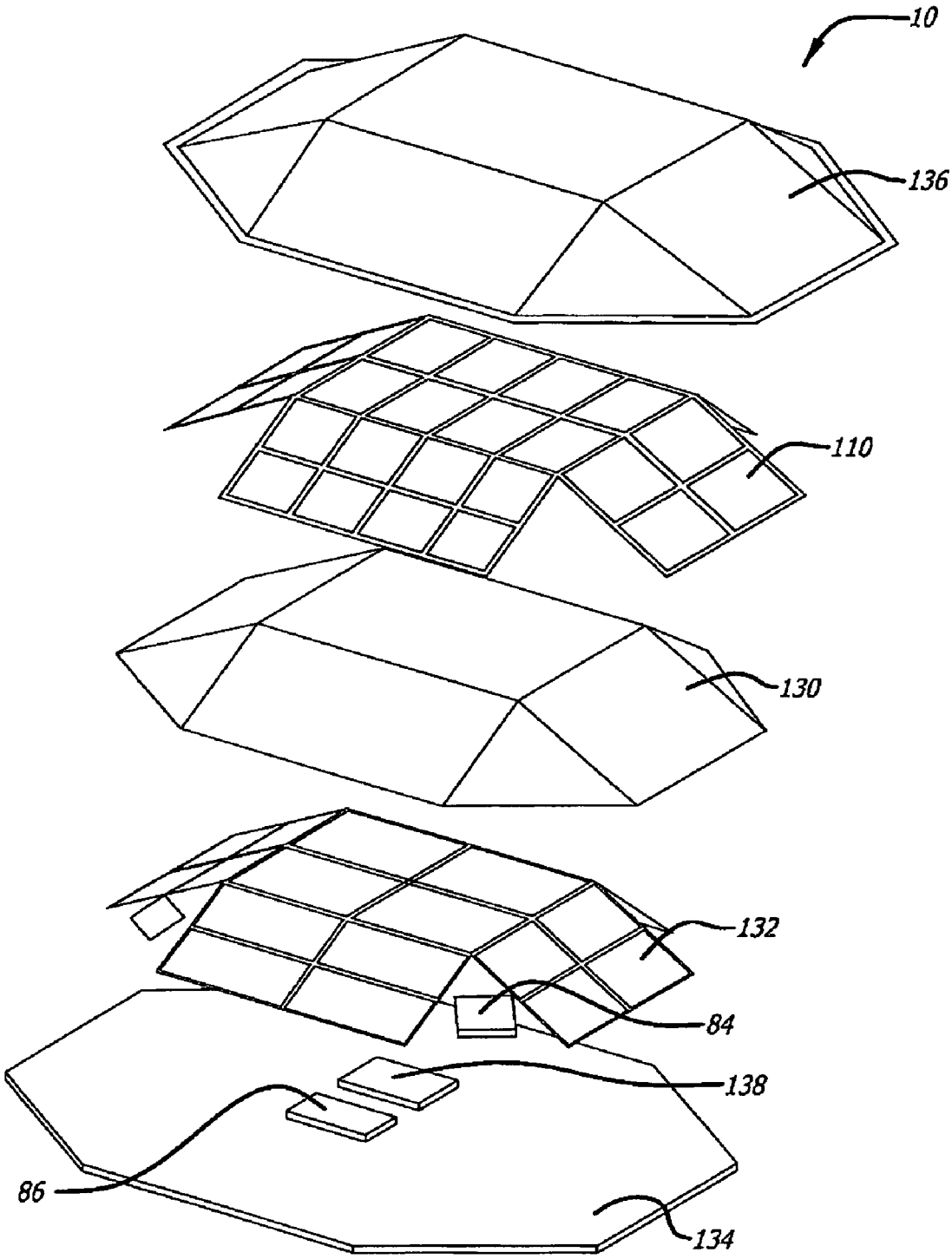
FIG. 5 is a simplified diagram showing an exploded view of an antenna designed in accordance with an illustrative embodiment of the present invention.

FIG. 5 is an exploded view of an antenna 10 designed in accordance with an illustrative embodiment of the present invention, showing the different layers of the antenna 10. The antenna 10 includes a plurality of 2×2 subarray antenna/circuit modules 110 mounted on a support structure 130. The support structure 130, which may be made from any rigid material such as metal or composite, is formed in the shape of the carapace design shown in FIGS. 1*a* and 1*b* , having a central top section 12 and four surrounding side sections 14 as described above. In the illustrative embodiment, four 2×2 modules 110 are used to form the:central section 12 of the array, and two 2×2 module 110 are used to form each of the side sections 14. Each 2×2 module 110 includes the radiating elements and associated electronics for four antenna elements, as described above with reference to FIGS. 4*a* and 4*b* . The illustrative antenna, 10 therefore includes 48 antenna elements total.

A manifold/aperture feed circuit board 132 is also attached to the support frame 104. The manifold 106 includes RF distribution circuits for receiving an RF signal from a modem 92 and distributing the signal to each of the T/R modules 30 of the antenna/circuit modules 110. The manifold 132 also includes RF combiner circuits for receiving RF signals from each of the T/R modules 30 and combining them to form a single RF signal that is sent to the input port of the modem 92 (as shown in FIG. 3). The manifold 132 may actually couple only one receive signal and one transmit signal to each subarray antenna/circuit module 110 if each antenna/circuit module 110 is equipped with its own intermediate distribution and combiner circuits as described above. For example, in the embodiment of FIG. 5, each subarray antenna/circuit module 110 has one RF output and one RF input, the module 110 including circuitry that distributes the RF input signal to each of the four antenna elements 20 of the module 110 and circuitry that combines the receive signals from each of the four antenna elements 20 to form one RF output. The manifold 132 includes four 3-to-1 combiners 84 that each combines the RF output signals from three of the twelve subarray antenna/circuit modules 110. A 4-to-1 combiner 86 then combines the signals output from the four 3-to-1 combiners 84 to form a single RF signal, which is coupled to the input port of the modem 92.

A flat metal sheet 134 provides a base for the antenna structure 10, and a radome 136 provides a protective cover over the patch antennas of the antenna/circuit modules 110. The antenna 10 may also include a power supply 138, such as a battery, housed in the hollow space above the base 134 for providing power to the various electronic components. The space above the base 134 may also be adapted to house the modem 92. The modem 92 may be connected to a user data terminal (such as a computer or laptop) via, for example, an Ethernet or WiFi connection. The antenna 10 may also include a serial connector for coupling control signals from the user computer or other processor to the antenna/circuit modules 110 as described above with reference to FIG. 3.

Thus, the present invention has been described herein with reference to a particular embodiment for a particular application. Those having ordinary skill in the art, and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. An antenna comprising:

a first planar array of antenna elements;

one or more side planar arrays of antenna elements, each of the one or more side planer arrays being adjacent to said first planar array and tilted at a predetermined angle relative to said first planar array; and a processor adapted to turn off the antenna elements of the one or more side planar arrays depending on a relative location of a satellite, wherein the antenna elements in all of the side planar arrays are configured to be turned off when the satellite is above a particular elevation angle relative to the first planar array, wherein the antenna elements in one or more of the side planar arrays aligned with said satellite are configured to be turned on while the antenna elements in the other of the side planner arrays are configured to be turned off, when said satellite is below the particular elevation angle relative to the first planar array, and wherein the first planar array and the side planar arrays are configured to point a receive beam and a transmit beam in different directions at the same time.

2. The invention of claim 1 wherein said predetermined angle is based on a desired coverage of said antenna.

3. The invention of claim 2 wherein said coverage is near full upper hemisphere.

4. The invention of claim 3 wherein said predetermined angle is approximately forty-five degrees.

5. The invention of claim 1 wherein said antenna further includes a plurality of transmit/receive modules, one transmit/receive module coupled to each antenna element.

6. The invention of claim 5 wherein each transmit/receive module includes a receive channel for receiving and processing a signal from said antenna element and a transmit channel for processing and transmitting a signal to said antenna element.

7. The invention of claim 6 wherein each transmit/receive module further includes first means for simultaneously coupling said receive and transmit channels to said antenna element.

8. The invention of claim 7 wherein said first means includes a diplexer adapted to couple signals in a first frequency band to said receive channel and signals in a second frequency band to said transmit channel.

9. The invention of claim 8 wherein each receive channel includes a first phase shifter adapted to receive a first phase control signal and in accordance therewith control a relative phase of a signal received from said diplexer.

10. The invention of claim 9 wherein each transmit channel includes a second phase shifter adapted to receive a second phase control signal and in accordance therewith control a relative phase of a signal transmitted to said diplexer.

11. The invention of claim 10 wherein each receive channel also includes a low noise amplifier coupled between said diplexer and said first phase shifter.

12. The invention of claim 11 wherein each transmit channel also includes a high power amplifier coupled between said second phase shifter and said diplexer.

13. The invention of claim 12 wherein each transmit/receive module further includes second means for switching on or off said receive channel and/or transmit channel.

14. The invention of claim 13 wherein said second means includes a first switch coupled to said low noise amplifier and adapted to receive a first channel enable control signal and in accordance therewith turn said low noise amplifier on or off.

15. The invention of claim 14 wherein said second means includes a second switch coupled to said high power amplifier and adapted to receive a second channel enable control signal and in accordance therewith turn said high power amplifier on or off.

16. The invention of claim 15 wherein said processor is adapted to provide said channel enable control signals for each of said transmit/receive modules.

17. The invention of claim 15 wherein said antenna further includes a serial to parallel interface adapted to receive a serial input signal, said serial input signal including said phase and channel enable control signals for each transmit/receive module, and output said control signals to each transmit/receive module in parallel.

18. The invention of claim 6 wherein said antenna further includes means for combining signals received from each of said receive channels to form a single output signal.

19. The invention of claim 6 wherein said antenna further includes means for distributing an input signal to each of said transmit channels.

20. The invention of claim 5 wherein said antenna elements are patch antennas comprising patch radiators disposed over a ground plane.

21. The invention of claim 20 wherein said transmit/receive modules are implemented on a printed circuit board adjacent to and substantially parallel to said ground plane.

22. The invention of claim 21 wherein said transmit/receive modules are aperture coupled to said patch radiators.

23. The invention of claim 1 wherein the one or more side planar arrays comprise four side planar arrays surrounding said first planar array.

24. An antenna array comprising:

a plurality of antenna elements, wherein said antenna elements are arranged into a first planar array and one or more side planar arrays, wherein each side planner array is adjacent to said first planar array and tilted at a predetermined angle relative to said first planar array, and a plurality of transmit/receive modules, each transmit/receive module coupled to one of said antenna elements, wherein each transmit/receive module includes:

a diplexer coupled to the associated antenna element and adapted to couple signals in a first frequency band to a first port and signals in a second frequency band to a second port;

a receive circuit for processing a signal received from said first port of said diplexer, wherein said receive circuit includes a low noise amplifier adapted to receive a first channel enable control signal and in accordance therewith amplify said signal from said diplexer, and a first phase shifter adapted to receive a first phase control signal and in accordance therewith vary a phase of said signal from said diplexer; and a transmit circuit for processing an input signal and coupling a resulting signal to said second port of said diplexer, wherein said transmit circuit includes a high power amplifier adapted to receive a second channel enable control signal and in accordance therewith amplify said input signal for transmission by said antenna element, and a second phase shifter adapted to receive a second phase control signal and in accordance therewith vary a phase of said input signal, wherein the receive circuit and the transmit circuit are configured such that the plurality of antenna elements point a receive beam and a transmit beam in different directions at the same time; and a processor adapted to turn off the antenna element of the one or more side planar arrays depending on a relative location of a satellite, wherein the antenna elements in all of the side planar arrays are configured to be turned off when the satellite is above a particular elevation angle relative to the first planar array, and wherein the antenna elements in one or more of the side planar arrays aligned with said satellite are configured to be turned on while the antenna elements in the other of the side planar arrays are configured to be turned off, when said satellite is below the particular elevation angle relative to the first planar array.

25. The invention of claim 24 wherein said antenna elements are patch antennas comprising patch radiators disposed on a patch substrate over a ground plane.

26. The invention of claim 25 wherein said transmit/receive modules are implemented on a printed circuit board adjacent to and substantially parallel to said ground plane.

27. A method for communicating with a satellite including the steps of:

providing a first planar array of antenna elements;

providing one or more side planar arrays of antenna elements, each side array adjacent to said first array and tilted at a predetermined angle relative to said first planer array;

operating a processor to turn off the antenna elements of the one or more side planar arrays depending on a relative location of a satellite, wherein the antenna elements of all of the side planar arrays are turned off when the satellite is above a particular elevation angle relative to the first planar array, and wherein the antenna elements in one or more of the side planar arrays aligned with said satellite are turned on while the antenna elements in the other side planar arrays are turned off, when said satellite is below the particular elevation angle; and varying a relative phase of each antenna element to produce a first beam and a second beam respectively pointing toward different satellites at the same time.

* * * * *